United States Patent [19]

Dubil et al.

[11] 4,110,835

[45] Aug. 29, 1978

[54] BUCKET BRIGADE CIRCUIT FOR SIGNAL SCALING

[75] Inventors: James F. Dubil, Warrenton, Va.; Howard N. Leighton, Rockville, Md.; Raymond J. Wilfinger, Lagrangeville, N.Y.

[73] Assignee: International Business Machines Corporation, Armonk, N.Y.

[21] Appl. No.: 829,418

[22] Filed: Aug. 31, 1977

[51] Int. Cl.[2] ..... G06G 7/16

[52] U.S. Cl. ..... 364/844; 307/221 D; 364/862

[58] Field of Search ..... 364/841, 850, 862, 844; 307/221 D, 221 C; 357/24; 328/167

[56] References Cited

U.S. PATENT DOCUMENTS

| | | | |
|---|---|---|---|
| 3,819,953 | 6/1974 | Puckette et al. | 307/221 D |
| 3,819,954 | 6/1974 | Butler et al. | 307/221 D |
| 3,867,645 | 2/1975 | Weimer | 307/221 D |
| 3,956,624 | 5/1976 | Audaire et al. | 364/841 X |
| 4,032,767 | 6/1977 | Lagnado | 364/862 |

OTHER PUBLICATIONS

Heller — "Bucket-Brigade Delay Line with Loss Compensation" — IBM Tech. Disclosure Bulletin, vol. 13, No. 12, May 1971, pp. 3734, 3735.

*Primary Examiner*—Joseph F. Ruggiero
*Attorney, Agent, or Firm*—John E. Hoel

[57] ABSTRACT

A charge transfer device capacitive ratio voltage multiplication circuit has been devised which solves the problem of cumulative DC bias offset by adding a DC signal compensation branch to prevent the accumulation of DC offset potential. The circuit can be expanded to form a weighted sum of multiple inputs which does not incur any corresponding DC bias offset, by making the sum of the characteristic capacitances of each of the multiple inputs equal to the characteristic capacitance of the output portion of the charge transfer device circuit. The circuit allows arithmetic operations to be performed on input signals solely in the charge domain without the necessity of converting charge to voltage to charge, thereby avoiding losses, distortions, offsets and a reduction in dynamic range which would otherwise result.

2 Claims, 6 Drawing Figures

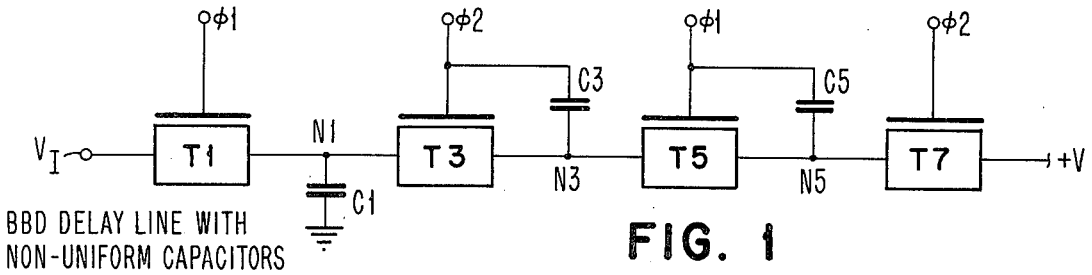
FIG. 1
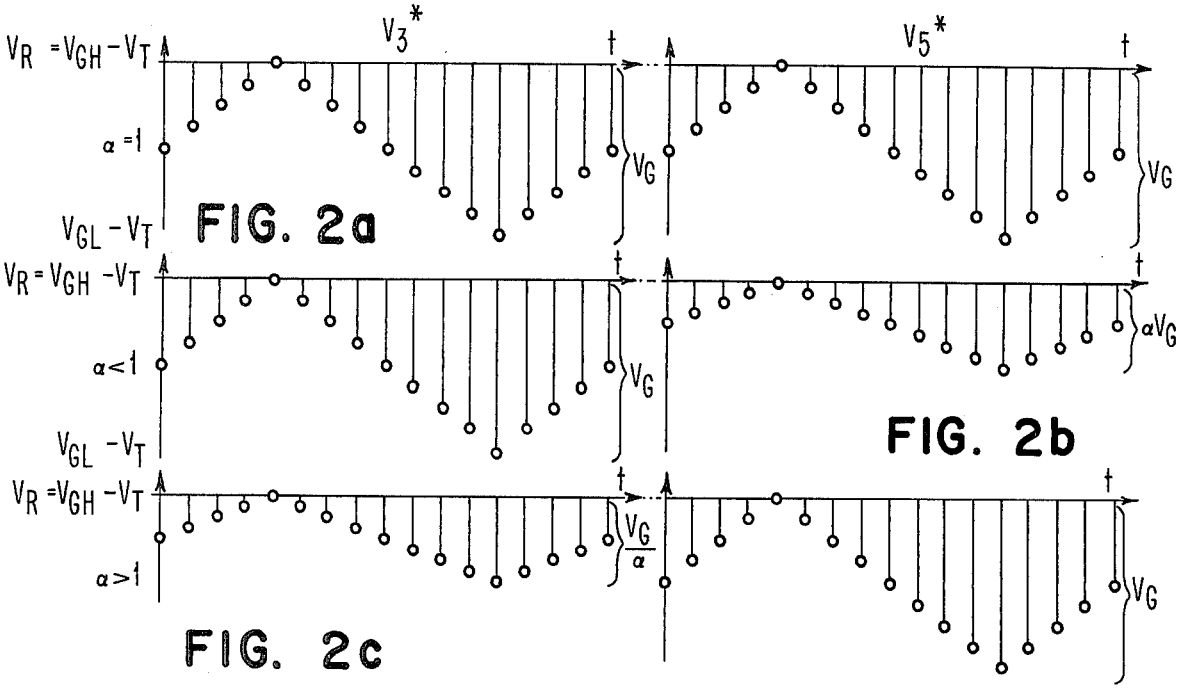
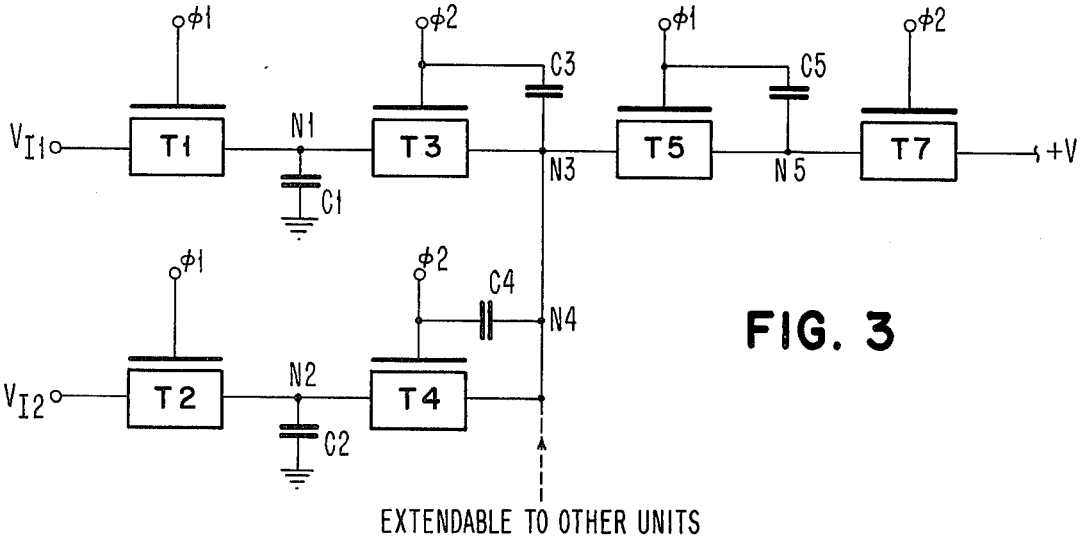
FIG. 3

BUCKET BRIGADE CIRCUIT FOR SIGNAL SCALING

FIELD OF THE INVENTION

The invention disclosed relates to semiconductor device circuits and more particularly relates to charge transfer device circuits.

BACKGROUND OF THE INVENTION

The invention relates to bucket-brigade circuits of the type described in "IEEE Journal of Solid-State Circuits", June 1969, pp. 131-136. Such bucket-brigade circuits comprise a plurality of stages which are all of the same kind, and each of which consists of a transistor and a capacitor arranged between the gate and the drain terminal thereof, and which are connected in series such that the drain terminal of one is connected to the source terminal of the following transistor. The gate terminals of the odd-numbered transistors are controlled by a first square-wave clock signal, and the gate terminals of the even-numbered transistors are controlled by a second square-wave clock signal of the same frequency whose pulses are 180° out of phase with the pulses of the first clock signal.

OBJECTS OF THE INVENTION

It is an object of the invention to provide an improved charge-transfer device capable of performing the common signal processing function of signal voltage multiplication by a constant.

It is another object of the invention to sum signals applied to two or more input ports of a BBD delay line directly in the form of charge without off-set or distortion.

It is a further object to provide a BBD summation operation in conjunction with a signal multiplying operation to multiply the varying information portion of one or more signals without multiplying their DC component.

It is still another object of the invention to provide a summation operation to compensate for DC offset attributable to any normal BBD operation, in an improved manner.

It is still a further object of the invention to provide a BBD summation technique which permits two or more independent signal processing functions to be cascaded or merged directly in the form of charge without intermediate stages of charge-to-voltage conversion.

It is yet another object of the invention to provide corresponding minimum FET W/L ratios or transconductances which are uniquely determined such that the BBD array size required to perform the desired signal processing function is minimized.

It is still a further object of the invention to provide a BBD array size minimization technique which permits two or more independent signal processing functions to be cascaded or merged directly in the form of charge without excessive attenuation or dispersion and without intermediate stages of the charge-to-voltage conversion.

SUMMARY OF THE INVENTION

These and other objects, features and advantages of the invention are provided by the bucket brigade signal scaling invention disclosed herein.

A charge transfer device capacitive ratio voltage multiplication circuit has been devised which solves the problem of cumulative DC bias offset by adding a DC signal compensation branch to prevent the accumulation of DC offset potential. The circuit can be expanded to form a weighted sum of multiple inputs which does not incur any corresponding DC bias offset, by making the sum of the characteristic capacitances of each of the multiple inputs equal to the characteristic capacitance of the output portion of the charge transfer device circuit. The circuit allows arithmetic operations to be performed on input signals solely in the charge domain without the necessity of converting charge to voltage to charge, thereby avoiding losses, distortions, offsets and a reduction in dynamic range which would otherwise result.

DESCRIPTION OF THE FIGURES

These and other objects, features and advantages will be more fully appreciated with reference to the accompanying drawings.

FIG. 1 is a schematic circuit diagram of a bucket brigade delay line with non-uniform capacitors.

FIG. 2*a* is a graph of the waveforms $V_3^*$ and $V_5^*$ versus $t$ for $\alpha = 1$.

FIG. 2*b* is a graph of the waveforms $V_3^*$ and $V_5^*$ versus $t$ for $\alpha < 1$.

FIG. 2*c* is a graph of the waveforms $V_3^*$ and $V_5^*$ versus $t$ for $\alpha > 1$.

FIG. 3 is a schematic circuit diagram of a bucket brigade delay line with provision for summing and offset compensation.

Figure 4:
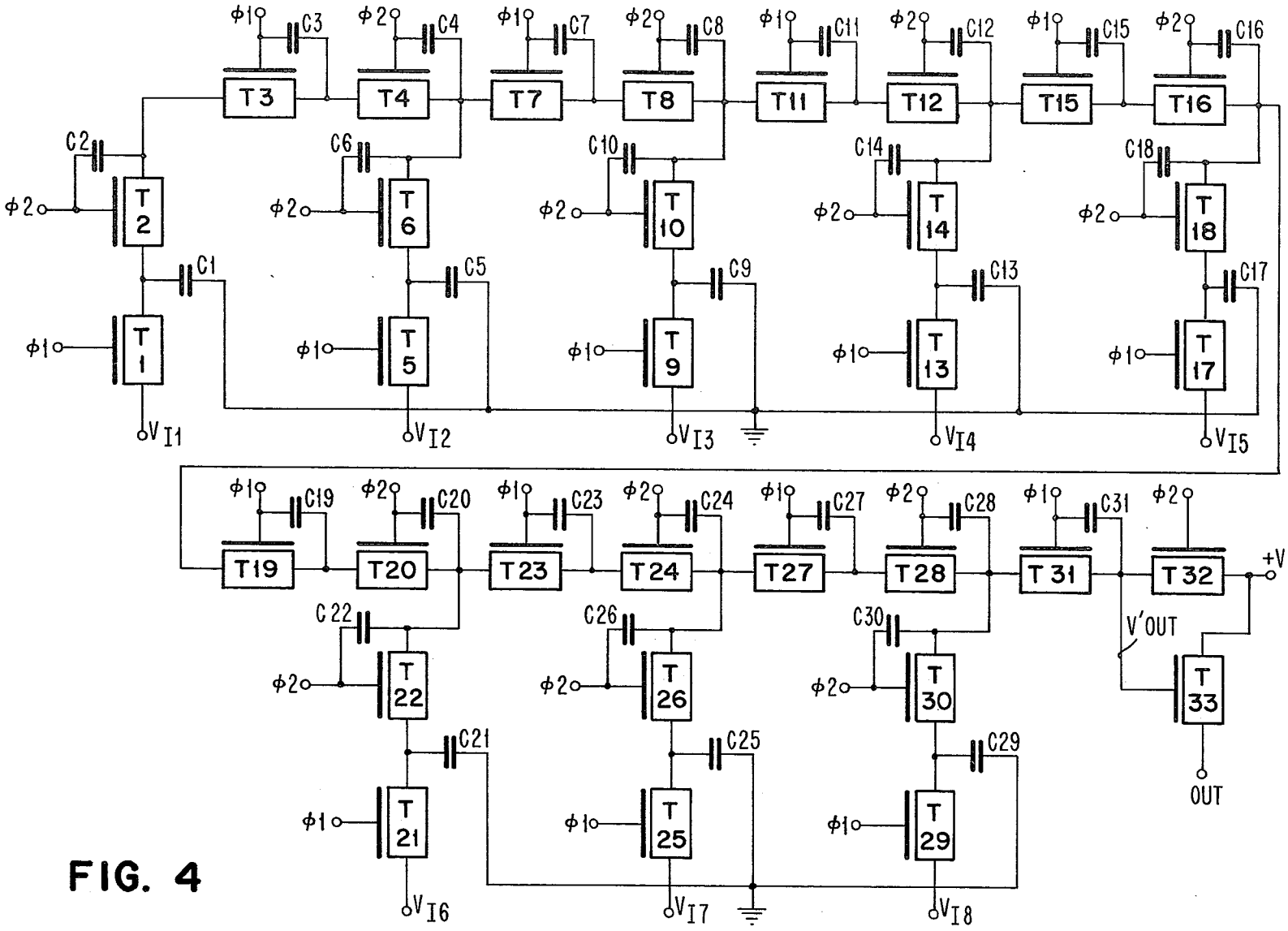
FIG. 4 is a schematic circuit diagram of an eight-tap parallel in/serial out bucket brigade circuit for performing a sum of products function $$V\text{OUT} = V_{oc} + \sum_{i=1}^{8} V_i(t - i\tau)$$

without the accumulation of a DC bias voltage, where $\tau$ is a unit delay of one clock period.

DISCUSSION OF THE PREFERRED EMBODIMENT

Conventional bucket brigade (BBD) delay lines attempt to preserve the original amplitude of the input signal, but there are instances where one would like to change the signal amplitude. Transversal filter tap weight control, beamformers, correlators and charge amplifiers are four possible applications. One technique for changing the signal amplitude is by means of BBD cell capacitance ratios provided that the constraints of the BBD linear signal range are not exceeded.

The linear signal range of any general BBD cell is bounded by $V_{GH}$-$V_T$ and $V_{GL}$-$V_T$, where $V_{GH}$ is the maximum clock level, $V_T$ is the BBD MOSFET threshold voltage, and $V_{GL}$ is the minimum clock level. The maximum permissible change in voltage across the cell capacitor is the difference between the two bounds, or $V_{GH} - V_{GL} = V_G$ where $V_G$ is the clock amplitude.

Consider the BBD array of FIG. 1. Let $C_1 = C_3 = \alpha C_5$ and $C_5 = C_R$ where $\alpha$ is the capacitance scaling factor $C_3/C_R$ and $C_R$ is the largest capacitor in the array. Conservation of charge predicts that the change in charge on $C_5$ must be identical to the change in charge on $C_3$ during each and every clock interval:

$$\Delta Q_5 = \Delta Q_3$$

$$\Delta V^*_5 C_5 = \Delta V^*_3 C_3$$

$$\Delta V^*_5 = \alpha(\Delta V^*_3) \quad (1)$$

Note that the voltage $\Delta V^*_3$ is multiplied by $\alpha$ to obtain $\Delta V^*_5$. Relationship (1) is demonstrated in FIG. 2 where it is seen that $V_3^*$ is represented by sampled values which are equal to the input voltage, $V_I$ since $C_3 = C_1$, and $V_5^*$ is a scaled replica to $V_3^*$. The fixed DC offset terms that appear when $\alpha \neq 1$ do not alter the significance of equation (1) since they do not alter the basic shape of $V_5^*$. Delay between $V_3^*$ and $V_5^*$ may be determined to be one-half clock period by inspection of FIG. 1, and since simple delay does not contribute to signal distortion, delay will be ignored in the following comparisons of $V_3^*$ and $V_5^*$. Three cases will be examined: $\alpha = 1$, $\alpha < 1$, and $\alpha > 1$ for amplitude and offset.

$\alpha = 1$

When $\alpha = 1$, $V_5^* = V_3^*$ and both $V_3^*$ and $V_5^*$ may swing over the full linear signal range as shown in FIG. 2*a*. This is the normal operating condition for simple BBD delay lines.

$\alpha < 1$ (attenuation)

When $\alpha < 1$, the peak-to-peak signal excusions of $V_5^*$ are less than those of $V_3^*$ as shown in FIG. 2*b*. But there is a positive DC offset introduced such that $V_5^* = V_3^*$ only when both have the value $V_R$ at the upper bound of the linear signal range. Note that if $V_3^*$ remains within the linear signal range when $\alpha < 1$, then $V_5^*$ always will fall within the linear signal range, but $V_5^*$ will not be centered between the linear signal range bounds.

$\alpha > 1$ (amplification)

When $\alpha > 1$, the peak-to-peak signal excursion of $V_5^*$ are greater than those of $V_3^*$ as shown in FIG. 2*c*. The amplitude of $V_3^*$ has been reduced such that $V_5^*$ just swings over the full linear signal range. Again there is a DC offset such that $V_5^* = V_3^*$ only when both have the value $V_R$ at the upper bound of the linear range. Note that if $V_5^*$ remains within the linear range when $\alpha > 1$, then $V_3^*$ always will fall within the linear range, but $V_3^*$ will not be centered between the linear range bounds.

Thus, it is demonstrated that signals may be multiplied in BBD arrays by scaling the capacitor ratio from one cell to the next. Distortion will occur when the signal in any cell exceeds the linear range bounds.

In the previous discussion it was shown that if unequal capacitors are used in adjacent bucket brigade device (BBD) cells to modify signal amplitudes, a signal offset will be introduced. A reduction in signal distortion and loss might be realized if a DC offset compensation term could be introduced such that the signal voltage variation at each node is centered between the linear signal range bounds. In addition, signal processing functions are simplified if the offset compensation term is chosen so that a particular value of signal voltage, $V_o$, passes from one cell to the next without change. For example, if in FIG. 3, $V_{I1} = V_o + A \sin \omega_1 t$ is applied to the input of a first input branch consisting of $T_1$, $C_1$, $T_3$ and $C_3$, then it would be preferred that the bias voltage $V_o$ remain constant in all cells, so that the least distortion occurs in this special but common case for $V_o = V_{oc}$, where $V_{oc} = (V_{GH} + V_{GL} - 2V_T)/2$, and the linear operating region is defined as $V_{oc} \pm V_G/2$. No offset compensation is required to achieve a common value of $V_o$ when adjacent capacitors have the same value, but when adjacent capacitors are not equal, the additional legs of the BBD array in FIG. 3 may provide a means for compensating for the offset term.

When $C_3 = \alpha C_5 = \alpha C_R$, and $\alpha < 1$, FIGS. 3 and 2 indicate that a positive DC voltage $V_{I2}$ applied to the input of a second input branch consisting of $T_2$, $C_2$, $T_4$ and $C_4$ would shift $V_5^*$ in a negative direction to compensate for offset. There is no loss in generality if $V_{I1} = V_o$, where $V_o$ is any DC voltage to be passed along unmodified. One must find $V_{I2} = V'_o$ and capacitors $C_1$, $C_2$ and $C_4$ such that $V_3^* = V_5^* = V_o$. By conservation of charge, $$Q_5^* = Q_3^* + Q_4^* = Q_1^* + Q_2^*$$

$$C_5 V_5^* = C_3 V_3^* + C_4 V_4^* = C_1 V_1^* + C_2 V_2^*$$

$$C_R V_o = C_3 V_o + C_4 V_o = C_1 V_o + C_2 V'_o \quad (2)$$

There is no unique solution to equation (2), but it is observed that $C_3 + C_4 = C_R$, and if $C_1 + C_2 = C_R$, then $V'_o = V_o$. This choice permits the two input ports to be used interchangeably. This choice of capacitor values gives rise to the concept of "capacitance matching" in a BBD array that is analogous to impedance matching in a conventional transmission line. Individual capacitors must be chosen for the desired attenuation ratio, $\alpha$, but, as a general rule, offset will be eliminated if the sum of all capacitors at the same delay in an array yields a constant, $C_R$, which is the "characteristic capacitance" of the BBD array.

To summarize the case for a $\alpha < 1$ by means of an example, let $V_{I1} = V_{oc} + A \sin \omega_1 t$ and $V_{I2} = V_{oc} + B \sin \omega_2 t$. By conservation of charge, $$Q_5^* = Q_3^* + Q_4^* = Q_1^* + Q_2^*$$

$$C_5 V_5^* = C_1 V_1^* + C_2 V_2^*$$

$$V_5^* = \alpha V_{I1} + (1 - \alpha) V_{I2}$$

$$V_5^* = \alpha(V_{oc} + A \sin \omega_1 t) + (1 - \alpha)(V_{oc} + B \sin \omega_2 t)$$

$$V_5^* = V_{oc} + \alpha(A \sin \omega_1 t) + (1 - \alpha)(B \sin \omega_2 t) \quad (3)$$

The signal portions of $V_{I1}$ and $V_{I2}$ are multiplied by $\alpha$ and $1 - \alpha$ respectively, when they appear in the output branch consisting of $T_5$ and $C_5$, but the bias point $V_{oc}$ is retained in all cells. Although $T_7$ is shown as an output branch terminating device, it is evident that $T_7$ may be replaced by other cascaded BBD cells to continue the signal processing in the charge domain.

Relationship (3) summarizes the ability to multiply and sum signals while eliminating any offset term that would normally result from multiplication by capacitor ratios. The input signals need not be sinusoidal, and in general $$V_5^* = V_{oc} + \alpha V_a + (1-\alpha) V_b \quad (4)$$

where $V_a$ and $V_b$ are any general information carrying portion of $V_{I1}$ and $V_{I2}$.

In a special case of (4), $V_b$ may be a compensating voltage added to $V_{oc}$ to correct for offsets attributable to delay line deficiencies. $V_b$ might be supplied by an offset correcting feedback loop, for example. This special case is an improvement over previous techniques that empoyed either fixed compensation tailored to particular applications, or variable compensation that required special clocks and adjustable waveform shapers.

Unless some valid design criterion is established, BBDs may be overdesigned to enhance charge transfer efficiency, $\eta$, and the resulting BBD chip may be excessively large. The following is a method for determining the optimum W/L ratio for each cell in a BBD array given that $\eta_o$ is the minimum acceptable charge transfer ratio that will satisfy system performance, and given that cell capacitors have been chosen for the desired attenuation ratio, $\alpha$, in accordance with the above discussion of signal summation.

In FIG. 3, the W/L ratio of the MOSFET in any cell must be large enough to achieve the minimum acceptable charge transfer efficiency, but chip area minimization requires that each cell in the array has a W/L ratio that is no larger than necessary. The BBD of FIG. 3 is assigned a uniform minimum charge transfer efficiency of $\eta = \eta_o$ based on the maximum number of tranfers.

Charge transfer efficiency may be expressed as:

$$\eta = 1 - [1 + \gamma \cdot W\text{-}L/C \cdot V_o/4f_c]^{-1}$$

By fixing $\eta = \eta_o$ in each cell and assuming constant values for $\gamma$, $V_o$ and $f_c$, it is noted that the ratio (W/L)/C will be constant in all cells. In FIG. 3, $T_5$ must transfer the maximum charge that passes through the array, and therefore $(W/L)_5 = W/L)_R$, the maximum required value in the array. Since (W/L)/C is a constant for all cells with constant $\eta_o$, then:

$$\frac{(W/L)_R}{C_R} = \frac{(W/L)_5}{C_5} = \frac{(W/L)_4}{C_4} = \frac{(W/L)_3}{C_3} = \frac{(W/L)_2}{C_2} = \frac{(W/L)_1}{C_1} \quad (5)$$

$$(W/L)_1 + (W/L)_2 = (C_1/C_R)\ (W/L)_R + (C_2/C_R)\ (W/L)_R$$

$$(W/L)_1 + (W/L)_2 = (W/L)_R,$$

since $C_1 + C_2 = C_R$ from the previously discussed concept of characteristic capacitance. In a similar manner, $(W/L)_3 + (W/L)_4 = (W/L)_R$.

It is noted that the sum of all W/L ratios that feed charge to a given node will equal the sum of all W/L ratios that accept charge from that node when all cells have a common value of charge transfer efficiency. This concept of "W/L ratio matching" is analogous to impedance matching in a transmission line, and $(W/L)_R$ is the "characteristic W/L ratio" of the BBD array.

BBD chips implemented in accordance with (5) will have the minimum size that will satisfy the system performance goals. Other implementations would not be optimum.

FIG. 4 is a schematic circuit diagram of a bucket brigade circuit for performing a sum of products function $$V'OUT = V_{oc} + \sum_{i=1}^{8} V_i(t - i\tau)$$

without the accumulation of a DC offset voltage. It represents an extension of the single point summing of scaled signals shown in FIG. 3 to an eight-tap array. This extension iterates the single point concept by appropriate scaling of capacitors and W/L ratios or transconductances. DC offset is prevented, distortion is minimized, and the array size is optimized in FIG. 4 when the following relationships are maintained:

$$V_{11} = V_{oc} + V_a \qquad V_{15} = V_{oc} + V_e$$
$$V_{12} = V_{oc} + V_b \qquad V_{16} = V_{oc} + V_f$$
$$V_{13} = V_{oc} + V_c \qquad V_{17} = V_{oc} + V_g$$
$$V_{14} = V_{oc} + V_d \qquad V_{18} = V_{oc} + V_h$$
$$C_1 = C_2 = C_3 = C_4 = C_5 = C_6 = C_9 = C_{10} = C_{13} = C_{14} = C_{17} = C_{18} = C_{21} = C_{22} = C_{25} = C_{26} = C_{29} = C_{30} = C_o$$
$$C_7 = C_8 = C_4 + C_6 = 2C_o$$
$$C_{11} = C_{12} = C_8 + C_{10} = 3C_o$$
$$C_{15} = C_{16} = C_{12} + C_{14} = 4C_o$$
$$C_{19} = C_{20} = C_{16} + C_{18} = 5C_o$$
$$C_{23} = C_{24} = C_{20} + C_{22} = 6C_o$$
$$C_{27} = C_{28} = C_{24} + C_{26} = 7C_o$$
$$C_{31} = C_{28} + C_{30} = 8C_o$$
$$W/L_1 = W/L_2 = W/L_3 = W/L_4 = W/L_6 = W/L_9 = W/L_{10} = W/L_{13} = W/L_{14} = W/L_{17} = W/L_{18} = W/L_{21} = W/L_{22} = W/L_{25} = W/L_{26} = W/L_{29} = W/L_{30} = W/L_o$$
$$W/L_7 = W/L_8 = W/L_4 + W/L_6 = 2W/L_o$$
$$W/L_{11} = W/L_{12} = W/L_8 + W/L_{10} = 3W/L_o$$
$$W/L_{15} = W/L_{16} = W/L_{12} + W/L_{14} = 4W/L_o$$
$$W/L_{19} = W/L_{20} = W/L_{16} + W/L_{18} = 5W/L_o$$
$$W/L_{23} = W/L_{24} = W/L_{20} + W/L_{22} = 6W/L_o$$
$$W/L_{27} = W/L_{28} = W/L_{24} + W/L_{26} = 7W/L_o$$
$$W/L_{31} = W/L_{28} + W/L_{30} = 8W/L_o$$

A single source follower represented by $W/L_{33}$ serves as a non-destructive readout device to derive $V_{OUT}$ from $V'_{OUT}$.

While the invention has been particularly shown and described with reference to the preferred embodiments there of, it will be understood by those skilled in the art that the foregoing and other changes in form and details may be made therein without departing from the spirit and scope of the invention.

We claim:

1. In a charge transfer device, a capacitive ratio multiplier which avoids DC bias offset, comprising:

a first input branch having a first characteristic capacitance, an input node and an output node, with a first signal having an information component to be multiplied and a DC bias component, being applied at its input node;

an output branch having a second characteristic capacitance with its input node connected to said output node of said first input branch, the ratio of said first characteristic capacitance to said second characteristic capacitance providing an information component multiplication of said first signal as it propagates from said first input branch to said output branch;

a second input branch having a third characteristic capacitance with its output node connected to said input node of said output branch, the sum of said first and third characteristic capacitances equalling said second characteristic capacitance, said second input branch having an input node with a DC bias component;

whereby if the DC bias components in said first and said second input branches are equal, then they will equal the DC bias component in said output branch.

2. In a charge transfer device, a circuit for performing a weighted sum of multiple inputs, comprising:

a first input branch having a first characteristic capacitance, an input node and an output node, with a first signal having an information component to be multiplied and a DC bias component, being applied to said input node;

an output branch having a second characteristic capacitance with its input node connected to said output node of said first input branch;

a second input branch having a third characteristic capacitance, an input node and an output node, with its output node connected to said input node of said output branch, having an input node to which a DC bias component is applied;

a third input branch having a fourth characteristic capacitance, an input node and an output node, with its output node connected to said input node of said output branch, with a third signal having another information component to be multiplied and a DC bias component, being applied to said input node;

the ratio of said first characteristic capacitance to said second characteristic capacitance providing a multiplication for the information component of said first signal;

the ratio of the third characteristic capacitance to the second characteristic capacitance providing a multiplication for the information component of said third signal;

the sum of said first, third and fourth characteristic capacitances of said input branches being equal to said second characteristic capacitance of said output branch;

whereby a weighted sum of said first and third information components is performed without a DC bias offset.

* * * * *